US009765655B2

(12) United States Patent
Zschieschang et al.

(10) Patent No.: US 9,765,655 B2
(45) Date of Patent: Sep. 19, 2017

(54) CAMSHAFT ADJUSTING DEVICE

(71) Applicant: Schaeffler Technologies AG & Co. KG, Herzogenaurach (DE)

(72) Inventors: Torsten Zschieschang, Hagenbuechach (DE); Olaf Boese, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/901,920

(22) PCT Filed: May 21, 2014

(86) PCT No.: PCT/DE2014/200227
§ 371 (c)(1),
(2) Date: Dec. 29, 2015

(87) PCT Pub. No.: WO2015/000473
PCT Pub. Date: Jan. 8, 2015

(65) Prior Publication Data

US 2016/0369663 A1 Dec. 22, 2016

(30) Foreign Application Priority Data

Jul. 4, 2013 (DE) ..... 10 2013 213 132

(51) Int. Cl.
*F01L 1/34* (2006.01)
*F01L 1/344* (2006.01)

(52) U.S. Cl.
CPC ..... *F01L 1/3442* (2013.01); *F01L 1/34409* (2013.01); *F01L 2001/34426* (2013.01);
(Continued)

(58) Field of Classification Search
CPC ..... F01L 1/3442; F01L 2001/34453; F01L 2001/34426
(Continued)

(56) References Cited

U.S. PATENT DOCUMENTS 6,941,912 B2 9/2005 Palesch
7,198,013 B2 4/2007 Palesch
(Continued)

FOREIGN PATENT DOCUMENTS

DE 10205415 A1 8/2003
DE 102008011915 9/2009
(Continued)

*Primary Examiner* — Ching Chang
(74) *Attorney, Agent, or Firm* — Davidson, Davidson & Kappel, LLC

(57) ABSTRACT

A camshaft adjusting device including a vane cell adjuster with a stator which can be connected to a crankshaft of an internal combustion engine and with a rotor which is rotatably mounted in the stator and can be connected to a camshaft. The camshaft adjusting device also includes a central locking device for locking the rotor in a central locking position relative to the stator. In one or more of the vanes together: at least two pressure medium lines are provided, each of which fluidically connects two working chambers with different working directions to each other. Non-return valves with different working directions are provided in each pressure medium line, each non-return valve allowing a flow of the pressure medium between the working chambers in one direction and preventing the flow in the respective other direction depending on the rotational direction of the rotor relative to the stator. A first switchable valve device is provided in the respective other vanes which are not provided with non-return valves, the valve device allowing a flow of the pressure medium between the working chambers with different working directions in one switch position.

7 Claims, 4 Drawing Sheets

(52) U.S. Cl.
CPC ..... *F01L 2001/34453* (2013.01); *F01L 2001/34463* (2013.01); *F01L 2800/01* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 7,290,510 | B2 * | 11/2007 | Takahashi | F01L 1/022 123/90.12 |
| 8,800,512 | B2 | 8/2014 | Strauss | |
| 2007/0107684 | A1 | 5/2007 | Takahashi et al. | |

FOREIGN PATENT DOCUMENTS

| | | | |
|---|---|---|---|
| DE | 102008011916 | | 9/2009 |
| DE | 102008037997 | A1 | 2/2010 |
| DE | 102011007153 | | 10/2012 |
| EP | 1355047 | | 10/2003 |
| WO | WO2006/127348 | | 11/2006 |
| WO | WO2012/047748 | | 4/2012 |

* cited by examiner

CAMSHAFT ADJUSTING DEVICE

The present invention relates to a camshaft adjusting device.

BACKGROUND

Camshaft adjusting devices are generally used in valve train assemblies of internal combustion engines to vary the valve opening and closing times, whereby the consumption values of the internal combustion engine and the operating behavior in general may be improved.

One specific embodiment of the camshaft adjusting device, which has been proven and tested in practice, includes a vane adjuster having a stator and a rotor, which delimit an annular space, which is divided into multiple working chambers by projections and vanes. A pressure medium may be optionally applied to the working chambers, which is supplied to the working chambers on one side of the vanes of the rotor from a pressure medium reservoir in a pressure medium circuit via a pressure medium pump, and which is fed back into the pressure medium reservoir from the working chambers on the particular other side of the vanes. The working chambers whose volume is increased have an operating direction which is opposite to the operating direction of the working chambers whose volume is reduced. As a result, the operating direction means that an application of pressure medium to the particular group of working chambers induces a rotation of the rotor relative to the stator either in the clockwise or the counterclockwise direction. The control of the pressure medium flow, and thus the adjusting movement of the camshaft adjusting device, takes place, e.g., with the aid of a central valve having a complex structure of flow-through openings and control edges, and a valve body, which is movable within the central valve and which closes or unblocks the flow-through openings as a function of its position.

One problem with a camshaft adjusting device of this type is that the camshaft adjusting device is not yet completely filled with pressure medium in a start phase or may even have been emptied, so that, due to the alternating torques applied by the camshaft, the rotor may execute uncontrolled movements relative to the stator, which may result in increased wear and an undesirable noise development. To avoid this problem, it is known to provide a locking device between the rotor and the stator, which locks the rotor when the internal combustion engine is turned off in a rotation angle position with respect to the stator which is favorable for startup. In exceptional cases, for example if the internal combustion engine is stalled, it is possible, however, that the locking device does not properly lock the rotor, and the camshaft adjuster must be operated with an unlocked rotor in the subsequent start phase. However, since some internal combustion engines have a very poor start behavior if the rotor is not locked in the central position, the rotor must then be automatically rotated into the central locking position and locked in the start phase.

Such an automatic rotation and locking of the rotor with respect to the stator are known, for example, from DE 10 2008 011 915 A1 and from DE 10 2008 011 916 A1. Both locking devices described therein include a plurality of spring-loaded locking pins, which successively lock into locking gates provided on the sealing cover or the stator when the rotor rotates and which each permit a rotation of the rotor in the direction of the central locking position before reaching the central locking position while blocking a rotation of the rotor in the opposite direction. After the internal combustion engine has warmed up and/or the camshaft adjuster has been completely filled with pressure medium, the locking pins are forced out of the locking gates, actuated by the pressure medium, so that the rotor is subsequently able to properly rotate with respect to the stator to adjust the rotation angle position of the camshaft.

One disadvantage of this approach is that the locking of the rotor may be accomplished only with the aid of multiple successively locking locking pins, which results in higher costs. In addition, the locking procedure requires that the locking pins lock successively in a fail-safe manner. If one of the locking pins does not lock, the locking procedure may be interrupted, since the rotor is thus not locked in the intermediate position on one side and is able to rotate back.

SUMMARY OF THE INVENTION

It is an object of the present invention to provide a camshaft adjuster which has a fail-safe and cost-effective central lock of the rotor.

The present invention provides at least two pressure medium lines are provided together in one or multiple of the vanes, which fluidically connect two working chambers of different operating directions to each other, check valves of different operating directions being provided in each of the pressure medium lines, which facilitate an overflow of the pressure medium between the working chambers in one direction and prevent it in the other direction, as a function of the rotation direction of the rotor with respect to the stator, and a first switchable valve device, which facilitates an overflow of the pressure medium between the working chambers of different operating directions in one switching position, being provided in the particular other vanes, in which no check valve is provided.

Due to the proposed approach, the rotor may be rotated out of the stop positions into the central locking position solely by utilizing the active camshaft alternating torques, since the check valve device deliberately facilitates only an overflow of the pressure medium. As a result, the rotor rotates jerkily from the direction of the stop positions in the direction of the central locking position during the active camshaft alternating torques until it locks in the central locking position. The camshaft alternating torques are deliberately used to adjust the rotor only in one direction, since a flow of the pressure medium back through the check valve device is simultaneously prevented. Since, according to the present invention, a first switchable valve device, which facilitates the overflow of the pressure medium, is provided in the other vanes, in which no check valve is provided, the automatic adjusting movement is not blocked by the pressure medium present in the working chambers.

It is furthermore proposed that a second switchable valve device is provided in each of the vanes with the check valves, with the aid of which the flow of the pressure medium to the check valves is facilitated in a first switching position and prevented in a second switching position. Due to the proposed approach, the overflow of the pressure medium may be actively prevented, so that the camshaft adjusting device may be operated with the desired accuracy during the normal, actively controlled adjustment procedure.

It is furthermore proposed that a third switchable valve device is provided, which, in a first switching position, fluidically connects the working chamber into which the pressure medium flows via the check valve to a working chamber of the same operating direction which abuts another vane with a check valve situated therein and fluidically separates it in a second switching position. Since an automatic adjusting movement from the two "advance" and "retard" stop directions should be possible, two check valves of a different operating direction must be provided. If these check valves are provided in two different vanes, an overflow of the pressure medium only between two working chambers is provided with the aid of one check valve provided in the vane, while the overflow of the pressure medium between the working chambers is not possible via a vane which includes an oppositely acting check valve. Due to the proposed approach, in one switching position of the third valve device, the pressure medium is able to flow out of the working chamber having the reducing volume, from which the pressure medium is unable to overflow via the check valve and, via the third switchable valve device, into the working chamber from which the pressure medium is further able to overflow into the working chamber of the opposite operating direction on the other side of the vane via the check valve. In a second switching position of the third valve device, the working chamber is then deliberately separated from the other working chamber, so that the rotor is able to be supported on the stator via the pressure medium present in the working chamber during the automatic adjusting movement, and the automatic adjusting movement in this position of the third valve device is possible only in one rotation direction of the rotor.

It is furthermore proposed that a pressure medium may be applied jointly to the first, second and third valve devices with the aid of a multi-way switching valve. Due to the proposed approach, all three valve devices together may be transferred to a switching position, in which the pressure medium flow between the working chambers of different operating directions is prevented, and thus the automatic adjusting movement made possible according to the present invention is practically deactivated, and the camshaft adjusting device may be operated in the conventional way solely by the active application of pressure medium to the working chambers.

In particular, it is proposed that the working chambers into which the pressure medium flows via the check valves are fluidically connected to a pressure medium line which connects at least two working chambers of the same operating direction via one pressure medium line and to the third switchable valve device via another pressure medium line. As a result, two pressure medium lines, which are separated from each other, empty into the working chamber. One of the pressure medium lines then connects the working chamber to the pressure medium line which permanently connects the working chambers of the same operating direction, e.g., a ring line, for the purpose of actively applying pressure medium to the working chamber during the controlled adjusting movement. The other pressure medium line then connects the working chamber to the working chamber of the same operating direction at the vane which includes the check valve of the opposite operating direction and may be interrupted or opened by the third valve device, whereby the pressure medium flow described above for supporting the rotor or for the overflow of the pressure medium is achieved for the automatic adjusting movement.

It is furthermore proposed that at least one vane, including a first switchable valve device, is provided between the vanes which include the check valves in the circumferential direction. Due to the proposed approach, the available installation space in the rotor may be much better utilized for situating the pressure medium lines. This is advantageous, in particular, since two pressure medium lines empty into one of the working chambers which abut the vanes having the check valves, i.e., one pressure medium line emptying into the ring line and one pressure medium line leading to the third valve device, which run separately in at least one section.

BRIEF DESCRIPTION OF THE DRAWINGS

The present invention is explained in greater detail below on the basis of one preferred exemplary embodiment. The following are shown in detail in the figures.

DETAILED DESCRIPTION

Figure 1:
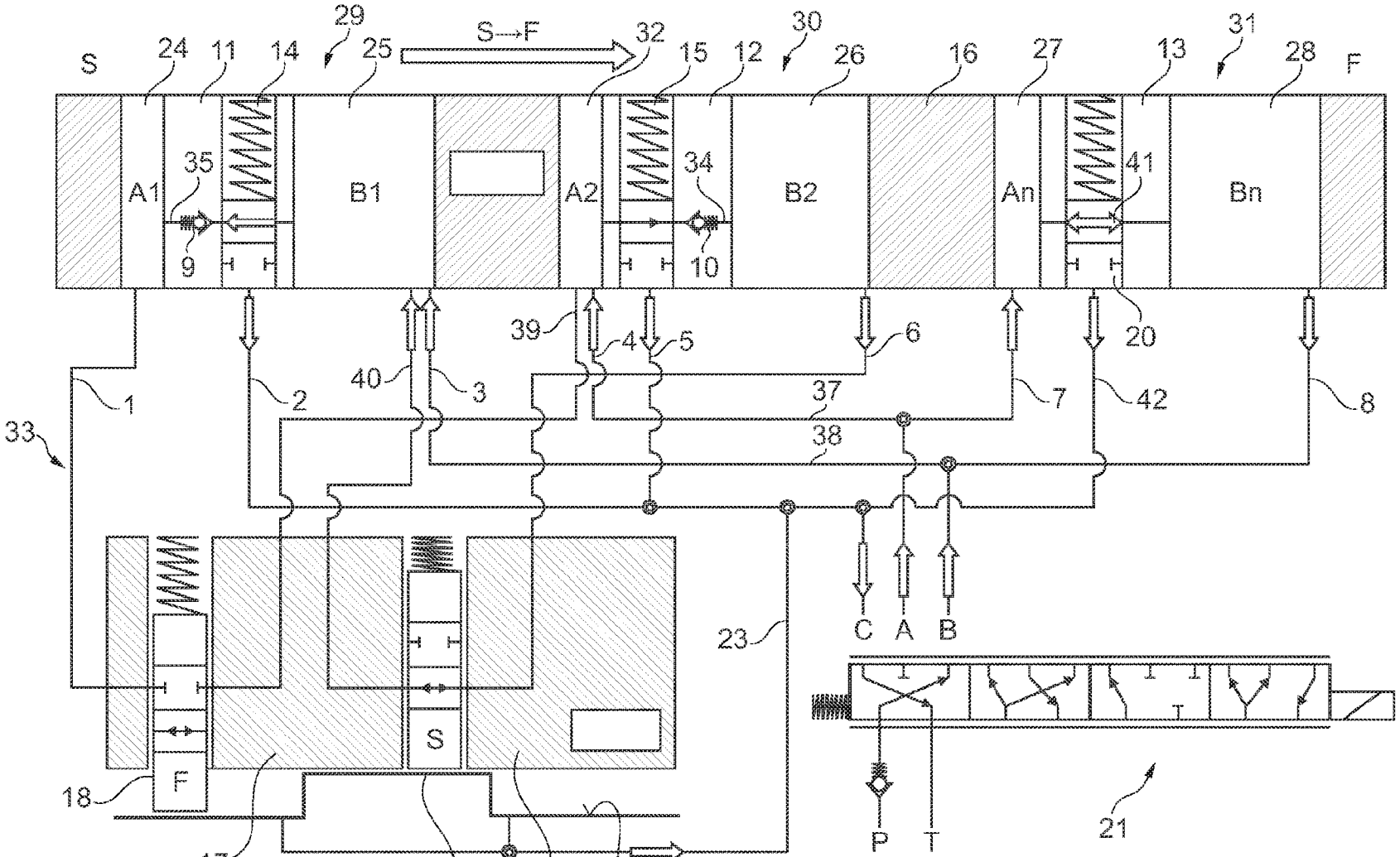
FIG. 1: shows a schematic representation of a camshaft adjusting device according to the present invention, including a circuit diagram of a pressure medium circuit in the position during an adjusting movement of the rotor from the "retard" direction into the central locking position.
Figure 2:
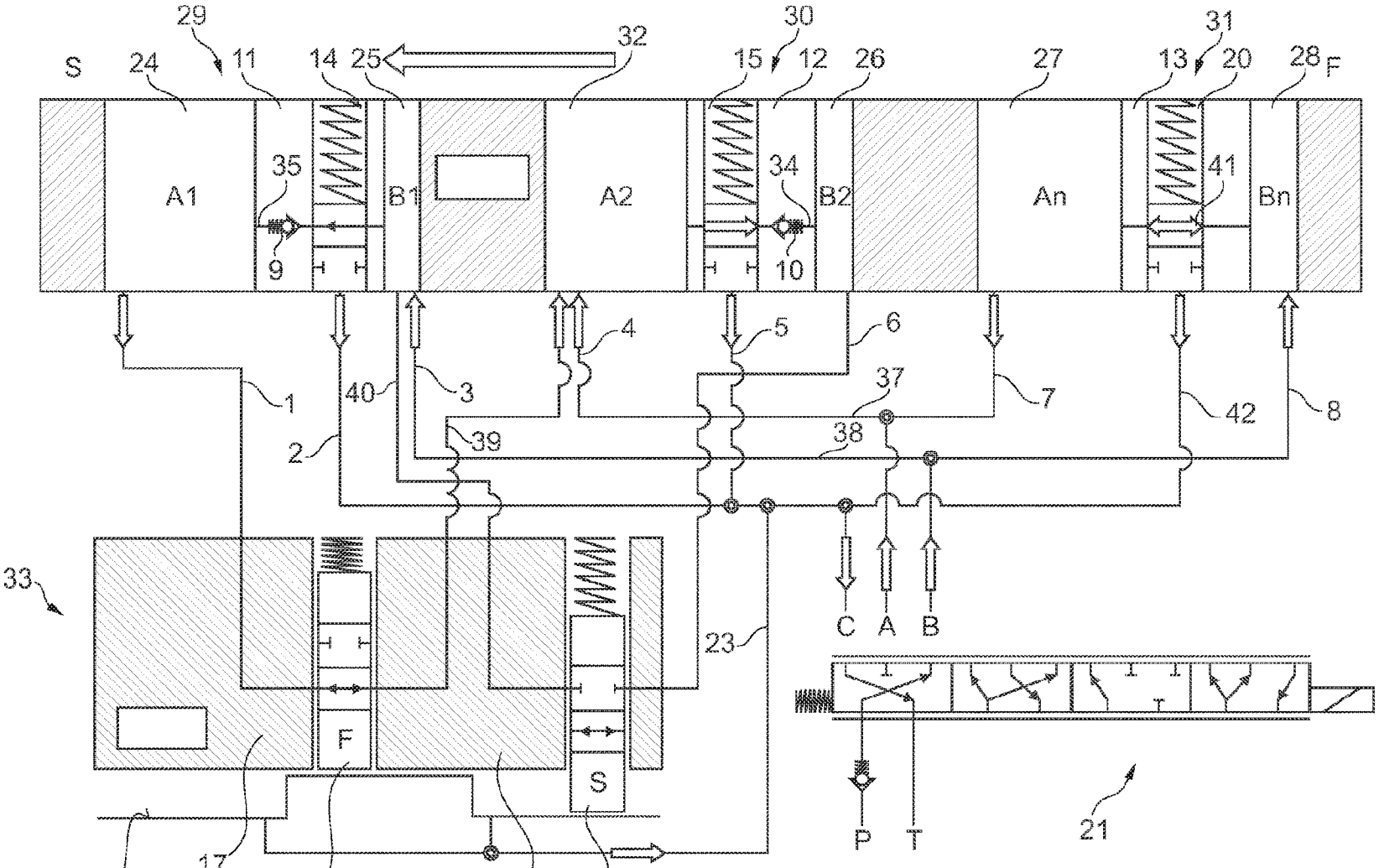
FIG. 2: shows a schematic representation of a camshaft adjusting device according to the present invention, including a circuit diagram of a pressure medium circuit in the position during an adjusting movement of the rotor from the "advance" direction into the central locking position.
Figure 3:
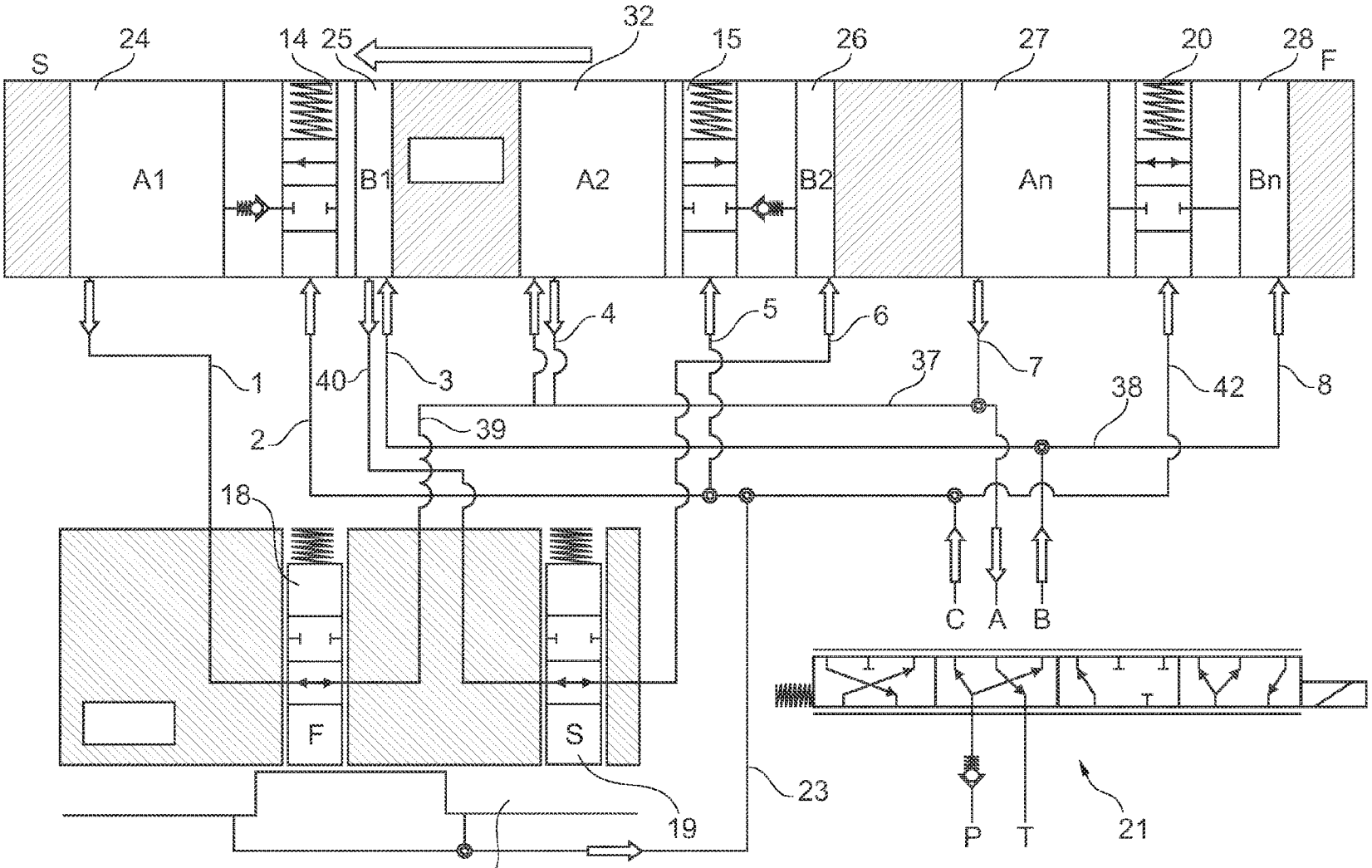
FIG. 3: shows a schematic representation of a camshaft adjusting device according to the present invention, including a circuit diagram of a pressure medium circuit during the adjusting movement in normal operation.

A camshaft adjusting device having a known basic structure with a schematically illustrated vane adjuster as a basic component is apparent from FIGS. 1 through 3, which includes a stator 16, drivable by a crankshaft which is not illustrated, and a rotor 17, which is rotatably fixedly connectable to a camshaft, also not illustrated, and which includes a rotor hub 36 and multiple vanes 11, 12 and 13 extending radially outwardly. In the upper representation, the vane adjuster is apparent in the developed view, while a detail of rotor hub 36 of rotor 17, which includes a central locking device 33, is schematically apparent at the bottom left, and a multi-way switching valve 21 for controlling the pressure medium flow is schematically apparent at the bottom right.

A pressure medium circuit is also apparent, which includes a large number of pressure medium lines 1, 2, 3, 4, 5, 6, 7, 8, 23, 37, 38, 39 and 40, which are optionally fluidically connectable to a pressure medium pump P or a pressure medium reservoir T, whereby, after the pressure medium has been fed back to pressure medium reservoir T via multi-way switching valve 21, pressure medium pump P conveys it from there and back into the pressure medium circuit.

Stator 16 includes a plurality of stator webs, which divide an annular space provided between stator 16 and rotor 17 into multiple pressure chambers 29, 30 and 31. Pressure chambers 29, 30 and 31, in turn, are divided by vanes 11, 12 and 13 of rotor 17 into working chambers 24, 25, 26, 27, 28 and 32, into which pressure medium lines 1, 3, 4, 6, 7, 8, 39 and 40 empty. Central locking device 33 includes two locking pins 18 and 19, which lock into a stator-fixed locking gate 22 for the purpose of locking rotor 17 with respect to stator 16. Locking gate 22 may be situated, for example, in a sealing cover screwed to stator 16.

In principle, the rotation angle of the camshaft with respect to the crankshaft during normal operation, i.e., in the "advance" direction, is adjusted by the fact that pressure medium is applied to working chambers 24, 32 and 27, thereby increasing their volume, while the pressure medium is simultaneously forced out of working chambers 25, 26 and 28, which reduces their volume. Working chambers 24, 25, 26, 27, 28 and 32, whose volume is increased in groups during this adjusting movement, are referred to, within the meaning of the present invention, as working chambers 24, 25, 26, 27, 28 and 32 of one operating direction, while working chambers 24, 25, 26, 27, 28 and 32, whose volume is simultaneously decreased, are referred to as working chambers 24, 25, 26, 27, 28 and 32 of the opposite operating direction. The change in volume of working chambers 24, 25, 26, 27, 28 and 32 then results in the fact that rotor 17, including vanes 11, 12 and 13, is rotated with respect to stator 16. In the top representation in FIG. 3, the volume of working chambers 25, 26 and 28 is increased by applying pressure medium via the B port of multi-way switching valve 21, while the volume of working chambers 24, 32 and 27 is simultaneously decreased by the back-flow of the pressure medium via the A port of multi-way switching valve 21. This change in volume then results in a rotation of rotor 17 with respect to stator 16, which results in a shifting of vanes 11, 12 and 13 to the left in the direction of the arrow in the developed view. To enable rotor 17 to be adjusted with respect to stator 16, central locking device 33 is first released by applying pressure medium to locking gate 22 via pressure medium lines 2 and 23 from the C port of multi-way switching valve 21 with the aid of pump P. By applying pressure medium to locking gate 22, locking pins 18 and 19 are forced out of locking gate 22, so that rotor 17 is able to subsequently rotate freely with respect to stator 16. To this extent, the camshaft adjusting device corresponds to the prior art.

According to the approach according to the present invention, pressure medium lines 34 and 35 are provided in vanes 11 and 12 and include check valves 9 and 10 situated therein, which facilitate an overflow of the pressure medium out of working chamber 25 into working chamber 24 and out of working chamber 32 into working chamber 26. The flow of the pressure medium through pressure medium lines 34 and 35 may furthermore be blocked or facilitated by a second switchable valve device, formed by a spring-loaded, movable valve body 14 and 15. For this purpose, valve bodies 14 and 15 have two switching positions, in which the flow-through is either released or blocked. Pressure medium may be applied to each of the switchable second valve devices via a pressure medium line 2 and 5, and these second valve devices are transferred from a first to a second switching position, which is apparent in FIG. 3, upon the application of pressure medium with the aid of a shifting of valve bodies 14 and 15 against the active spring force. In the second switching position, the flow through pressure medium lines 34 and 35 is blocked, so that working chambers 24 and 25 or 32 and 26 are to be viewed as separate from each other, and the camshaft adjusting device may be operated with a correspondingly high degree of adjusting accuracy without an overflow of the pressure medium between working chambers 24, 25, 32 and 26.

Central locking device 33 furthermore includes a third valve device, formed by two locking pins 18 and 19 in rotor hub 36. Locking pins 18 and 19 are designed as spring-loaded valve bodies, including corresponding grooves or bores, which are movable from a first switching position into a second switching position by applying pressure to locking gate 22 via pressure medium line 23 against the active spring force. Locking pins 18 and 19 are in the first switching position when they engage with locking gate 22 and the springs are relaxed.

The bores or grooves in locking pins 18 and 19 are situated in such a way that a flow of the pressure medium in the first switching position of locking pin 18 is blocked between pressure medium line 1 and pressure medium line 39 and pressure medium lines 40 and 6 with an unloaded spring, as is apparent in the positions in FIG. 1 and in FIG. 2. One of these positions illustrated in FIG. 1 or FIG. 2 is present if rotor 17 is not locked in the central locking position upon starting the internal combustion engine, and is rotated with respect to stator 16 either in the direction of the "retard" stop position or in the direction of the "advance" stop position. In the illustration, the "retard" stop position is identified by an S and the "advance" stop position by an F.

In both positions of rotor 17, one of locking pins 18 or 19 does not engage with locking gate 22 and is thus displaced into the second switching position against the spring force. The bores or grooves in locking pins 18 and 19 are situated in such a way that locking pins 18 and 19 facilitate a flow of the pressure medium between pressure medium lines 6 and 40 or 1 and 39 in the second switching position, while the flow through locking pin 18 or 19 engaging with locking gate 22 in the first switching position is blocked.

Pressure medium lines 6 and 40 or 1 and 39 are fluidically connected to working chambers 25 and 26 or 24 and 32, which are short-circuited thereby with the aid of locking pins 18 and 19 present in the second switching position. Pressure medium lines 3 and 8 empty into a partially annular or annular, shared pressure medium line 38 on rotor hub 36, which, in turn, is fluidically connectable to pressure medium pump "P" or pressure medium reservoir "T" via the B port of multi-way switching valve 21. With the aid of partial annular or annular pressure medium line 38, pressure medium may be jointly applied to working chambers 25 and 28 of an operating direction, or these working chambers may be connected to pressure medium reservoir "T." Pressure medium line 37 has the same function, via which pressure medium may be applied to working chambers 32 and 27 via the A port of multi-way switching valve 21, or these working chambers are connectable to pressure medium reservoir "T." Locking pins 18 and 19 separate each of pressure medium lines 1 and 39 or 6 and 40, in the locking position, in which they engage with locking gate 22, so that rotor 17 may be hydraulically supported, with active camshaft alternating torques, via working chamber 24 or working chamber 26 in the direction of the "advance" or "retard": adjusting direction.

Furthermore, a first switching valve device, formed by a spring-loaded, movable valve pin 20, is provided in vanes 13 in which no check valve 9 or 10 is provided. Valve pin 20 has a pressure medium line 41, e.g., in the form of a circumferential groove, through which working chambers 27 and 28 of different operating directions may be short-circuited on the side surfaces of vane 13 in a first switching position of the third valve device.

In the event that the camshaft adjusting device is not locked in the central locking position upon starting the internal combustion engine, and instead is rotated with respect to stator 16 in the direction of the "retard" stop position, rotor 17 is automatically rotated out of this rotated position, as is apparent in FIG. 1, from the direction of the "retard" (S) stop position in the direction of the central locking position in the direction of the arrow, in that the alternating torques acting upon the camshaft (CTA—Camshaft Torque Actuated) are used to allow the pressure medium to flow out of working chamber 25 through pressure medium line 35 into working chamber 24 via check valve 9. Since the other working chambers 27 and 28, which are separated from each other by vanes 13, each having one valve pin 20, are short-circuited in this position of valve pin 20 via pressure medium line 41, the pressure medium may overflow between these working chambers 27 and 28. Since the pressure medium is furthermore unable to flow out of working chamber 24, due to the locked position of locking pin 18, and it is also unable to flow back into working chamber 25 via check valve 9, rotor 17 is simultaneously unable to rotate back in the direction of the "retard" (S) stop position. Furthermore, working chamber 25, out of which the pressure medium flows via check valve 9, is fluidically connected via pressure medium line 40 and locking pin 19, situated in the unlocked position, to working chamber 26 of the same operating direction, which is also separated from a working chamber 32 of the opposite operating direction by a vane 12 which includes a check valve 10, so that the pressure medium is able to flow out of this working chamber 26 into working chamber 25 and finally into working chamber 24 via check valve 9 or out of working chamber 25 and into working chamber 28 via pressure medium lines 3, 38 and 8, and from there into working chamber 27 via pressure medium line 41.

Due to the proposed circuit, rotor 17 is practically supported on the pressure medium present in working chamber 24, the volume of working chamber 24 being increased by the pressure medium flowing in a pulsating manner via check valve 9, and rotor 17 is rotated thereby with respect to stator 16. Check valve 9 thus forms a freewheel, together with the correspondingly blocked or released pressure medium lines 1, 3, 4, 6, 7, 8, 39 and 40, with the aid of which rotor 17 is rotated with respect to stator 16 on one side in the direction of the central locking position, utilizing the alternating torques acting upon the camshaft, until locking pin 19 engages with locking gate 22 or until locking pin 18 comes into contact laterally with a stop of locking gate 22. Due to the engagement of locking pin 19 with locking gate 22, the latter automatically enters the first switching position, due to the active spring force, in which the previously released flow connection between pressure medium lines 40 and 6 is blocked and the short circuit produced thereby is released. As a result, another rotational movement of rotor 17 with respect to stator 16 is prevented, and rotor 17 is locked in the central locking position. It is particularly important for the functionality of the freewheel that working chambers 25 and 26 of pressure chambers 29 and 30 having the decreasing volume during the automatic adjusting movement are fluidically connected via the groove or the bore in locking pin 19, so that the pressure medium is able to flow out of working chamber 26 and does not impede the adjusting movement.

The reverse adjusting procedure from the direction of the "advance" (F) stop position in the direction of the central locking position is apparent in FIG. 2. The principle of the adjusting movement is identical. In this case, locking pin 18 is in the second switching position and thereby establishes a flow connection between pressure medium lines 1 and 39, so that working chambers 24 and 32 are fluidically connected to each other. Furthermore, locking pin 19 is in the first switching position and thereby blocks a flow of the pressure medium from working chamber 26 to working chamber 25, so that working chamber 26 is decoupled from the pressure medium circuit. In this case, when alternating torques occur during the start phase of the internal combustion engine, the pressure medium flows out of working chamber 32 via pressure medium line 34 and check valve 10 present therein into working chamber 26 and thereby increases its volume, since the outflow of the pressure medium is simultaneously prevented by blocked pressure medium line 6. At the same time, the pressure medium is unable to overflow from working chamber 24 into working chamber 25 due to the orientation of check valve 9. In order that the pressure medium present in working chamber 24 does not impede the adjusting movement, working chamber 24 is fluidically connected to working chamber 32 of pressure chamber 30 of the same operating direction via locking pin 18, which is in the second switching position, so that the pressure medium is able to flow out of working chamber 24 via pressure medium lines 1 and 39 into working chamber 32 and onward via check valve 10. During this adjusting movement, rotor 17 is supported on stator 16 via the pressure medium present in working chamber 26.

During the adjusting movement illustrated in both FIG. 1 and FIG. 2, multi-way switching valve 21 is in a basic position in which it is spring-loaded. During the shutdown of the internal combustion engine, multi-way switching valve 21 is automatically moved into the basic position, in which the C port is connected to pressure medium reservoir "T." The C port is connected to locking gate 22 via pressure medium line 23 and to valve bodies 14 and 15 and to valve pin 20 via pressure medium lines 2, 5 and 42, so that pressure medium is not applied to the first, second and third valve devices. If rotor 17 is not locked in the central locking position, the valve devices are either in the position shown in FIG. 1 or in FIG. 2, and rotor 17 is automatically rotated in the direction of the central locking position upon startup according to the operating principle described above. For the purpose of the active, controlled rotation of rotor 17, multi-way switching valve 21 is actuated and thereby displaced into a position in which pressure medium is applied to the C port and the B port via pressure medium pump "P," and the A port is connected to pressure medium reservoir "T." As a result, pressure medium is applied jointly to the valve devices, which are displaced into the second switching position against the active spring force, as is apparent in FIG. 3. As a result, valve bodies 14 and 15 and valve pin 20 are moved into a position in which the pressure medium is unable to overflow via vanes 11, 12 and 13. At the same time, locking pins 18 and 19 are displaced into a position in which pressure medium lines 1 and 39 or 40 and 6 are fluidically connected to each other, so that working chambers 24 and 32 or 25 and 26 are also fluidically connected to each other. To adjust rotor 17 in the illustrated position in the direction of the "retard" (S) stop position, pressure medium is applied to working chambers 25 and 28 via shared pressure medium line 38 and pressure medium lines 8 and 3 branching therefrom, while the pressure medium flows out of working chambers 27 and 32 and back into pressure medium reservoir "T" via pressure medium lines 7 and 4 and via shared pressure medium line 37 with the aid of the A port. Since working chambers 24 and 26 are simultaneously fluidically connected to working chambers 32 and 25 via locking pins 18 and 19, the pressure medium is also introduced into working chamber 26 and is removed from working chamber 24.

It is furthermore particularly important for the present invention that working chambers 24, 25, 26, 27, 28 and 32 of different operating directions, which are not part of the presently active freewheel, are each short-circuited via a valve pin 20, so that the automatic adjusting movement is not impeded by the pressure medium present in working chambers 24, 25, 26, 27, 28 and 32. It is particularly advantageous that valve pins 20 are situated in vanes 13 themselves, since this makes it possible to facilitate the overflow of the pressure medium directly without additional pressure medium lines.

Figure 4:
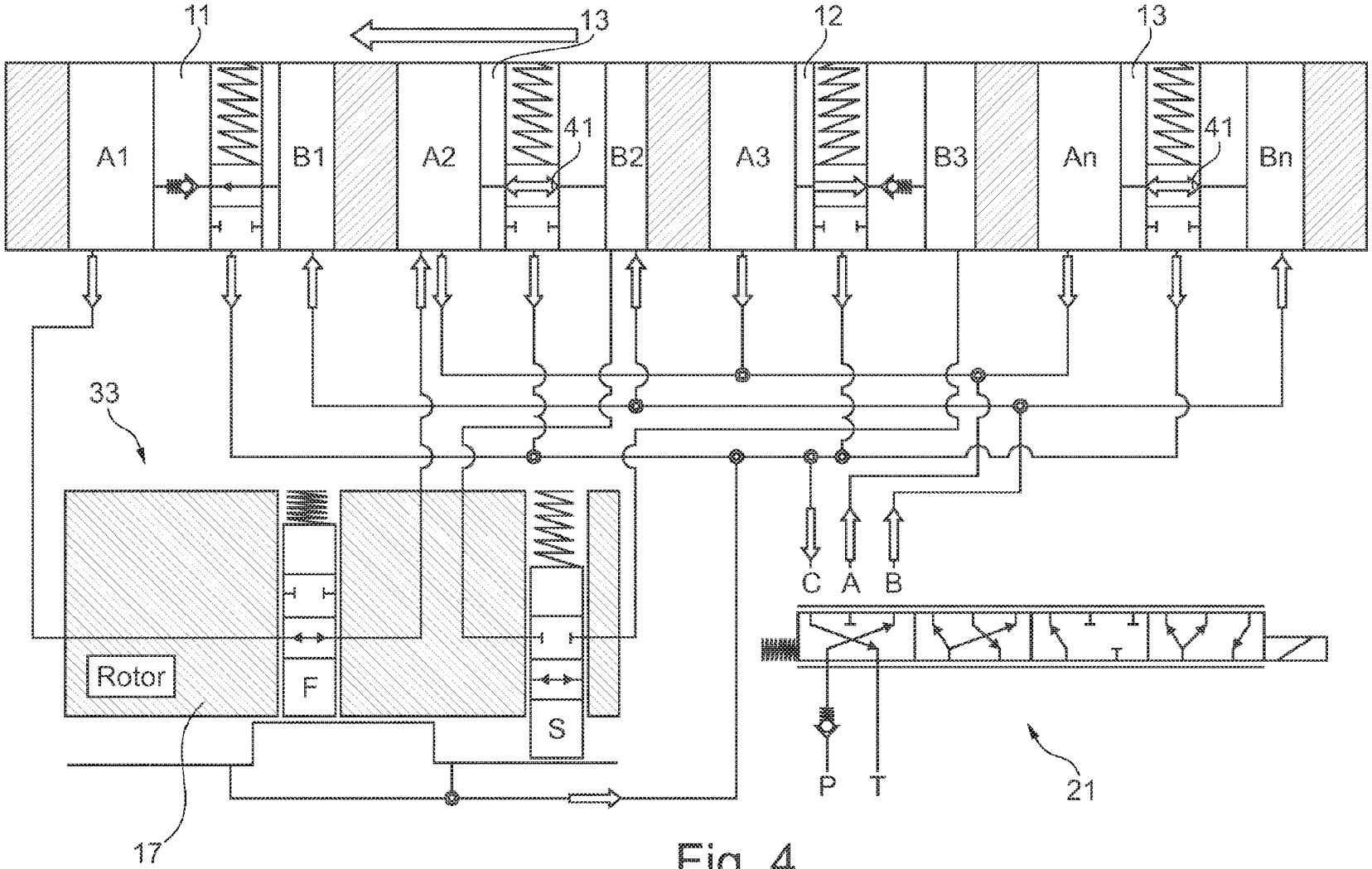
FIG. 4: shows an alternative specific embodiment of the camshaft adjusting device according to the present invention.

A further developed specific embodiment of the camshaft adjusting device according to the present invention is apparent in FIG. 4, in which pressure chambers 29 and 30, including vanes 11 and 12 with check valves 9 and 10, are not situated adjacent to each other, but instead encompass between them another pressure chamber 31, including a vane 13 with a pressure medium line 41 short-circuiting working chambers 27 and 28. Due to this refinement, the pressure medium lines, which are provided in rotor 17 by bores and grooves, may be situated in a much simpler manner. This is particularly advantageous because the available installation space for accommodating the pressure medium lines in rotor 17 is limited, and the pressure medium lines generally should not be allowed to cross, except for certain nodes. If rotor 17 includes four vanes 11, 12 and 13, for example, vanes 11 and 12, including check valves 9 and 10, or vane 13, including the first valve devices, are situated opposite to each other. The course of the pressure medium lines may be simplified thereby, it being possible, in particular, to make much better use of the material of rotor 17 for accommodating the pressure medium lines.

LIST OF REFERENCE NUMERALS

1 pressure medium line
2 pressure medium line
3 pressure medium line
4 pressure medium line
5 pressure medium line
6 pressure medium line
7 pressure medium line
8 pressure medium line
9 check valve
10 check valve
11 vane
12 vane
13 vane
14 valve body
15 valve body
16 stator
17 rotor
18 locking pin
19 locking pin
20 valve pin
21 multi-way switching valve
22 locking gate
23 pressure medium line
24 working chamber
25 working chamber
26 working chamber
27 working chamber
28 working chamber
29 pressure chamber
30 pressure chamber
31 pressure chamber
32 working chamber
33 central locking device
34 pressure medium line
35 pressure medium line
36 rotor hub
37 pressure medium line
38 pressure medium line
39 pressure medium line
40 pressure medium line
41 pressure medium line
42 pressure medium line

The invention claimed is:

1. A camshaft adjusting device comprising:

a vane adjuster including a stator connectable to a crankshaft of an internal combustion engine and a rotor rotatably supported in the stator connectable to a camshaft;

multiple webs on the stator and dividing an annular space between the stator and the rotor into a plurality of pressure chambers;

the rotor including a rotor hub and a plurality of vanes extending radially outwardly from the rotor hub and dividing the pressure chambers into two groups of working chambers of a different operating direction, inflowing or outflowing pressure medium may be applied to the two groups of working chambers in a pressure medium circuit; and a central locking device for locking the rotor in a central locking position with respect to the stator;

at least two pressure medium lines provided together in at least one of the vanes, each of the pressure medium lines fluidically connecting two working chambers of different operating directions to each other, check valves of different operating directions provided in each pressure medium line, each check valve facilitating overflow of the pressure medium between working chambers in one direction of the two group of working chambers and preventing overflow in the other direction as a function of the rotational direction of the rotor with respect to the stator; and a first switchable valve device provided in other vanes with no check valve, the first switchable device facilitating overflow of the pressure medium between the two groups of working chambers of different operating directions in one switching position.

2. The camshaft adjusting device as recited in claim 1 further comprising a second switchable valve body in the at least one vane having the check valves, flow of the pressure medium to the check valves being facilitated with the aid of the second switchable valve body in a first switching position and prevented in a second switching position.

3. The camshaft adjusting device as recited in claim 2 further comprising a third switchable valve device, the third switchable device, in a first switching position, fluidically connecting a first working chamber into which the pressure medium flows via the check valve to a further working chamber of the same operating direction abutting another vane with a check valve situated therein and fluidically separating the first working chamber and the further working chamber in a second switching position.

4. The camshaft adjusting device as recited in claim 3 wherein the pressure medium may be applied jointly to the first, second and third switchable valve devices with the aid of a multi-way switching valve.

5. The camshaft adjusting device as recited in claim 3 wherein the working chamber and the further working chamber into which the pressure medium flows via the check valves are fluidically connected to a pressure medium line connecting the first working chamber and the further working chamber of the same operating direction via a further pressure medium line and to the third switchable valve device via another pressure medium line.

6. The camshaft adjusting device as recited in claim 1 wherein the other vanes are provided in a circumferential direction including check valves and further vanes including further check valves.

7. The camshaft adjusting device as recited in claim 1 further comprising a further switchable valve device, the further switchable device, in a first switching position, fluidically connecting a first working chamber into which the pressure medium flows via the check valve to a further working chamber of the same operating direction abutting another vane with a check valve situated therein and fluidically separating the working chamber and the further working chamber in a second switching position.

* * * * *